US011208843B2

(12) United States Patent
Lu

(10) Patent No.: US 11,208,843 B2
(45) Date of Patent: Dec. 28, 2021

(54) HAND-HELD NARROW-EDGE ZEBRA CURTAIN

(71) Applicant: Ningbo Zhenfei Decorated Curtain Co., Ltd., Yuyao (CN)

(72) Inventor: Jiefei Lu, Yuyao (CN)

(73) Assignee: NINGBO ZHENFEI DECORATED CURTAIN CO., LTD., Yuyao (CN)

( * ) Notice: Subject to any disclaimer, the term of this patent is extended or adjusted under 35 U.S.C. 154(b) by 209 days.

(21) Appl. No.: 16/236,160

(22) Filed: Dec. 28, 2018

(65) Prior Publication Data

US 2020/0208467 A1 Jul. 2, 2020

(51) Int. Cl.
*E06B 9/42* (2006.01)
*E06B 9/62* (2006.01)

(52) U.S. Cl.
CPC . *E06B 9/42* (2013.01); *E06B 9/62* (2013.01)

(58) Field of Classification Search
CPC ..... E06B 9/40; E06B 9/42; E06B 9/60; E06B 9/62; E06B 9/322; E06B 2009/2405; E06B 2009/3222; E06B 2009/3225
See application file for complete search history.

(56) References Cited

U.S. PATENT DOCUMENTS

| | | | | |
|---|---|---|---|---|
| 7,380,582 | B1 * | 6/2008 | Anderson | E06B 9/34 160/323.1 |
| 8,471,818 | B2 * | 6/2013 | Wu | G06F 3/0221 345/168 |
| 9,702,187 | B2 * | 7/2017 | Holt | E06B 9/44 |
| 9,963,935 | B2 * | 5/2018 | Faller | E06B 9/90 |
| 2004/0226663 | A1 * | 11/2004 | Smith | E06B 9/68 160/84.05 |
| 2009/0223641 | A1 * | 9/2009 | Cheng | E06B 9/42 160/318 |
| 2015/0308188 | A1 * | 10/2015 | Lin | B65H 75/486 242/375.3 |

* cited by examiner

*Primary Examiner* — Daniel P Cahn
*Assistant Examiner* — Matthew R. Shepherd
(74) *Attorney, Agent, or Firm* — Hamre, Schumann, Mueller & Larson, P.C.

(57) ABSTRACT

A hand-held curtain is provided. The curtain includes a left bracket, a right bracket corresponding to the left bracket, and a pylon connected to the left bracket and the right bracket. A scroll is arranged on the left bracket and the right bracket; a roller blind is arranged on the scroll; and coiling apparatuses used for coiling the scroll are respectively arranged on the left bracket and the right bracket.

6 Claims, 4 Drawing Sheets

HAND-HELD NARROW-EDGE ZEBRA CURTAIN

TECHNICAL FIELD

The utility model relates to the technical field of window curtains, and in particular to a hand-held narrow-edge zebra curtain.

BACKGROUND

The existing spring roller blind generally comprises a bracket and a scroll which are arranged on both sides, and a spring bar is arranged in the scroll. A limiting spring is sleeved on the spring bar, and a spring tail plug is installed at the end part of the limiting spring. The resilience force of the limiting spring requires rotation in advance according to the size and weight of the curtain to supply force. Moreover, the resilience circles of the spring bar with this structure are limited. The resilience force is not balanced. If more resilience circles and more balanced resilience force are needed, a longer spring bar is needed, but a window curtain with small width cannot be put. Therefore, this structure is only applicable to a single-layer and big size curtain but the double-layers roller blind needs double cloth, so the resilience circle of the spring bar are limited.

SUMMARY

(I) Technical Problems to Be Solved

The purpose of the utility model is to overcome the above defects, to provide a hand-held narrow-edge zebra curtain.

(II) Technical Solution

To achieve the above purpose, a hand-held narrow-edge zebra curtain of the utility model comprises a left bracket, a right bracket corresponding to the left bracket, and a pylon connected to the left bracket and the right bracket, wherein a scroll is arranged on the left bracket and the right bracket and a roller blind is arranged on the scroll. Coiling apparatuses used for coiling the scroll are respectively arranged on the left bracket and the right bracket. Each coiling apparatus comprises:

a regulating plunger nested with a toothed turntable;

a leaf spring, a reed fixing disc and a reed coiling disc, wherein the leaf spring is sleeved on the reed fixing disc in a relaxed state, and the coiling end of the leaf spring is clamped with the reed coiling disc, wherein the reed coiling disc has a first gear; and a second gear engaged with the first gear, wherein the second gear is also inserted with the regulating plunger.

Further, the regulating plunger comprises:

a plunger body in interference fit with the scroll, wherein a via hole is formed in the center of the plunger body; and a plunger shaft, wherein the front part of the plunger shaft is provided with a clamping part clamped with the via hole, an internal spline is arranged in the center of the tail of the plunger shaft, and the central section of the plunger shaft has a bump.

Further, the turntable is hollow, and has a small notch assembled with the bump at the hollow part; the front part of the turntable also has a hollow column with a large notch; the hollow column is used for the plunger shaft to penetrate; and the bottom of the turntable is provided with a slot part assembled with the tail of the plunger shaft.

Further, the second gear is provided with an external spline matched with the internal spline.

Further, the left bracket and the right bracket have the same structure, and have a shell and an end cover which are symmetrical; the end cover and the shell are mutually buckled and screwed; the shell is provided with a through hole used for the external spline to penetrate; and the shell is also provided with a groove for installing the reed fixing disc and the reed coiling disc.

Further, the groove has a first positioning pin and a second positioning pin used for inserting the reed fixing disc and the reed coiling disc.

Further, the bottom of the roller blind is provided with a bottom rod; a counterweight is arranged in the bottom rod; and the middle of the bottom rod is provided with a handle part.

(III) Beneficial Effects

Compared with the prior art, the technical solution of the utility model has the following advantages: the zebra curtain of the present application realizes torsion presetting by installing leaf springs, thereby regulating the contraction torque of the scroll and completely receiving the curtain. Furthermore, by adopting the zebra curtain with this design, a side edge of the zebra curtain can be designed to be much narrower than that of a conventional zebra curtain, so that a shading effect is better.

DETAILED DESCRIPTION

Specific embodiments of the utility model are further described below in detail in combination with drawings and the embodiments. The following embodiments are used for describing the utility model, not used for limiting the scope of the utility model.

Figure 1:
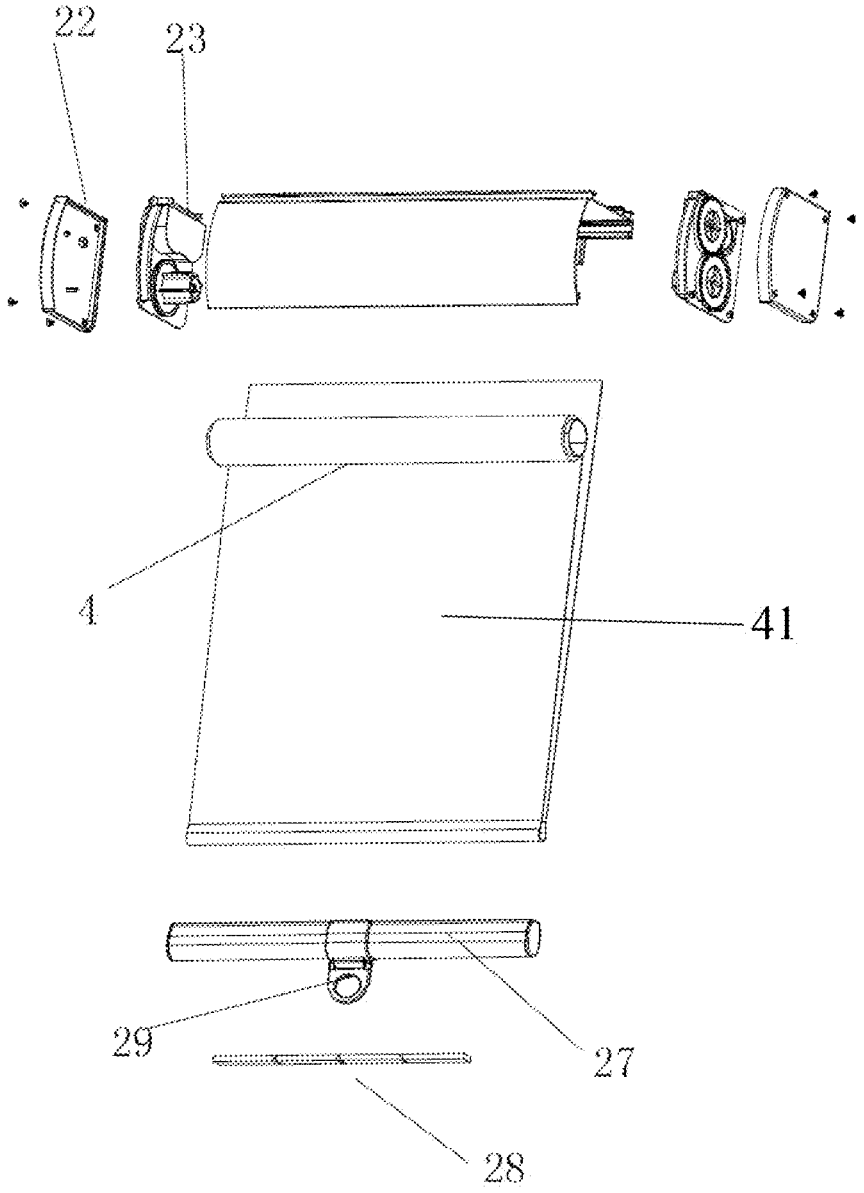
FIG. 1 is an exploded view of a hand-held narrow-edge zebra curtain of the utility model.
Figure 2:
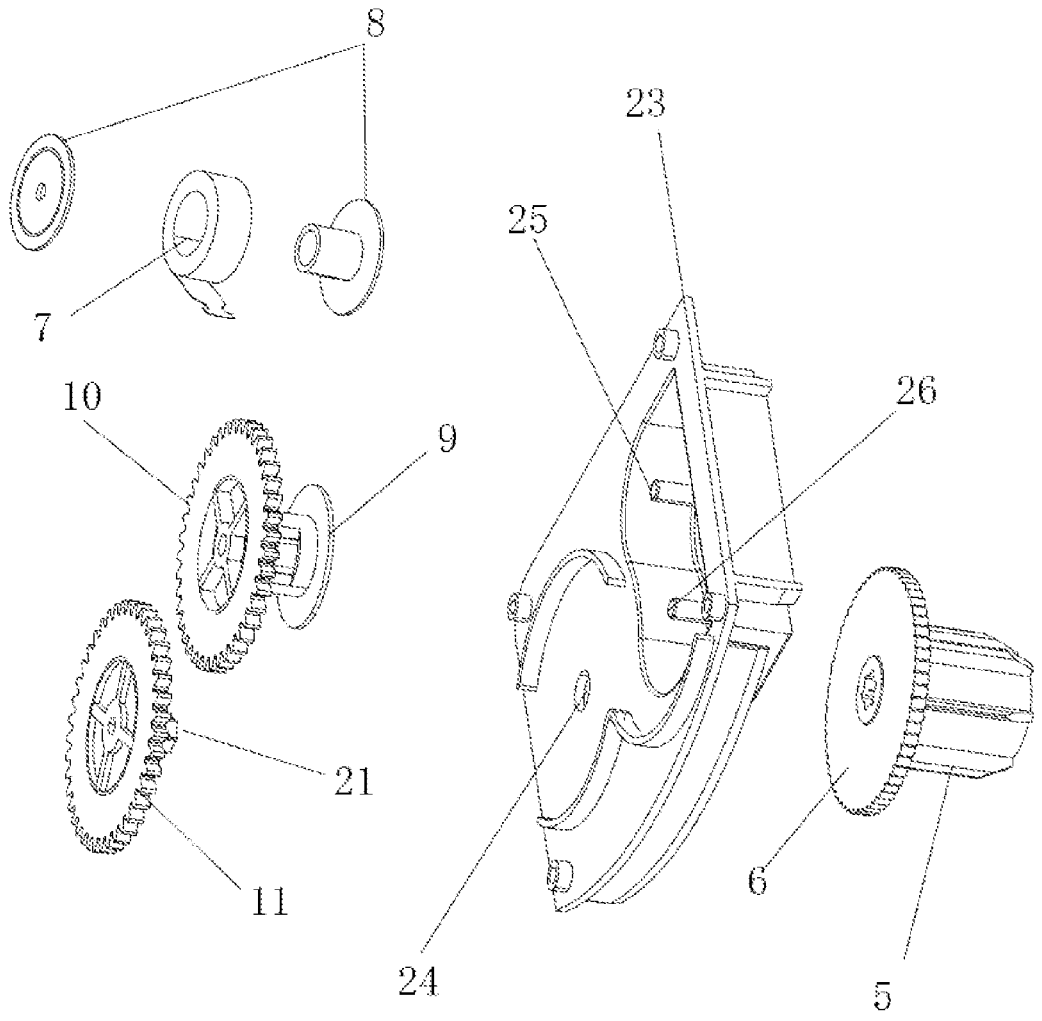
FIG. 2 is a structural schematic diagram of a coiling apparatus of a hand-held narrow-edge zebra curtain of the utility model.
Figure 3:
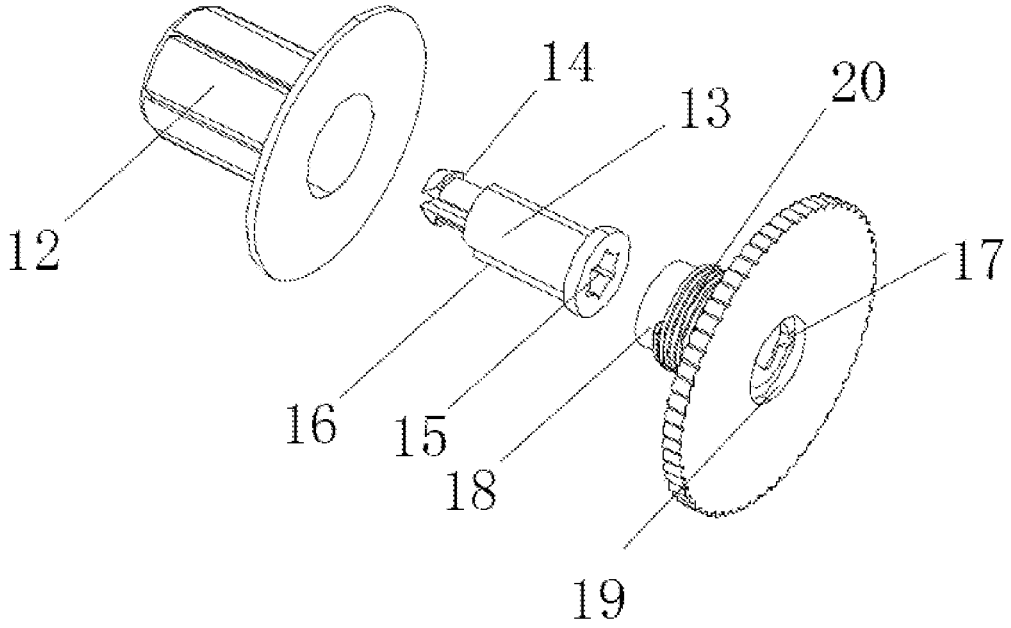
FIG. 3 is a structural schematic diagram of a regulating plunger of a hand-held narrow-edge zebra curtain of the utility model.
Figure 4:
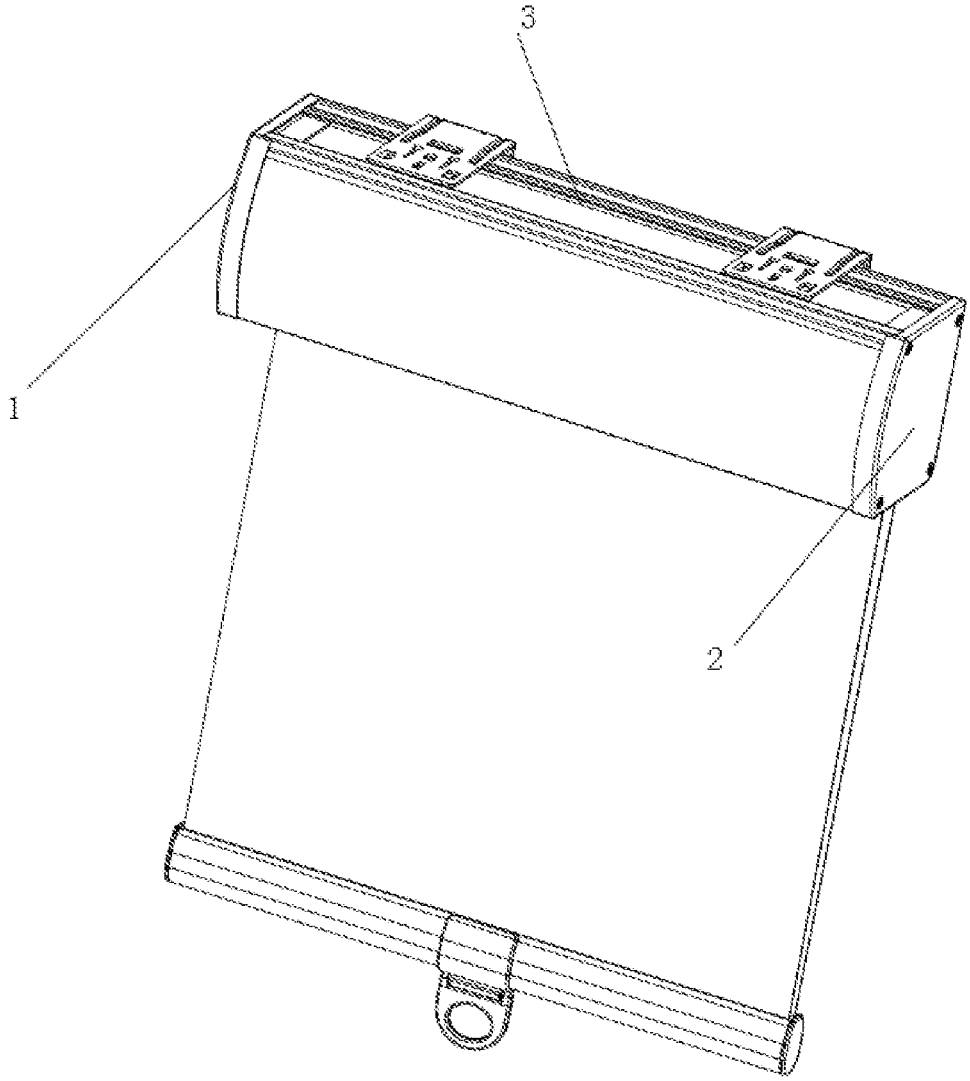
FIG. 4 is a schematic diagram after a hand-held narrow-edge zebra curtain of the utility model is assembled.

As shown in FIG. 1 to FIG. 4, a hand-held narrow-edge zebra curtain of the utility model comprises a left bracket 1, a right bracket 2 corresponding to the left bracket 1, and a pylon 3 connected to the left bracket 1 and the right bracket 2, wherein a scroll 4 is arranged on the left bracket 1 and the right bracket 2 and a roller blind 41 is arranged on the scroll 4. Coiling apparatuses used for coiling the scroll 4 are respectively arranged on the left bracket 1 and the right bracket 2. The roller blind in the present embodiment is a double-layer zebra curtain. One layer is fixed to the pylon 3, and the other layer is wound to the scroll 4. The zebra curtain is a curtain formed by alternately arranging euphotic layers and shading layers so as to facilitate users in regulating the bright degree. Each coiling apparatus comprises:

a regulating plunger 5 nested with a toothed turntable 6;

a leaf spring 7, a reed fixing disc 8 and a reed coiling disc 9, wherein the leaf spring 7 is sleeved on the reed fixing disc 8 in a relaxed state, and the coiling end of the leaf spring 7 is clamped with the reed coiling disc 9, wherein the reed coiling disc 9 has a first gear 10; and a second gear 11 engaged with the first gear 10, wherein the second gear 11 is also inserted with the regulating plunger 5.

The regulating plunger 5 comprises:

a plunger body 12 in interference fit with the scroll 4, wherein a via hole is formed in the center of the plunger body 12; and a plunger shaft 13, wherein the front part of the plunger shaft 13 is provided with a clamping part 14 clamped with the via hole, an internal spline 15 is arranged in the center of the tail of the plunger shaft 13, and the central section of the plunger shaft 13 has a bump 16.

The turntable 6 is hollow, and has a small notch 17 assembled with the bump 16 at the hollow part; the front part of the turntable 6 also has a hollow column 18 with a large notch; the hollow column 18 is used for the plunger shaft 13 to penetrate; and the bottom of the turntable 6 is provided with a slot part 19 assembled with the tail of the plunger shaft 13. The periphery of the hollow column 18 also has an embracing spring 20 for the purpose that the plunger shaft 13 passes through the embracing spring 20 to embrace the plunger body 12 fixedly.

The second gear 11 is provided with an external spline 21 matched with the internal spline 15.

The left bracket 1 and the right bracket 2 have the same structure, and have a shell 22 and an end cover 23 which are symmetrical; the end cover 23 and the shell 22 are mutually buckled and screwed; the shell 22 is provided with a through hole 24 used for the external spline 21 to penetrate; and the shell 22 is also provided with a groove for installing the reed fixing disc 8 and the reed coiling disc.

The groove has a first positioning pin 25 and a second positioning pin 26 used for inserting the reed fixing disc 8 and the reed coiling disc 9.

The bottom of the roller blind is provided with a bottom rod 27; a counterweight 28 is arranged in the bottom rod 27; and the middle of the bottom rod 27 is provided with a handle part 29. The counterweight 28 is determined according to the width and the material weight of the practical curtain, and the number of the counterweight 28 can be properly increased and decreased.

During assembly, the external spline 21 of the second gear 11 penetrates through the through hole 24 and is inserted into the internal spline 15. The reed fixing disc 8 and the reed coiling disc 9 are inserted into the corresponding first positioning pin 25 and the corresponding second positioning pin 26. The first gear 10 and the second gear 11 are engaged. The shell 22 and the end cover 23 are buckled to ensure that the first gear 10, the second gear 11, the reed fixing disc 8 and the reed coiling disc 9 are not loosened in the shell 22. During use, the leaf spring 7 accumulates torque while the roller blind moves down. Under the matching of the counterweight 28, as long as the handle part 29 is pulled down, the zebra curtain can be pulled and stopped at any time. If the torque is not sufficient when the curtain is received, as long as the turntable 6 is rotated, the turntable 6 drives the first gear 10 and the second gear 11 which are engaged, so that the leaf spring 7 is coiled properly by the reed coiling disc 9. The torque sufficient for receiving the curtain is preset to completely receive the curtain.

The zebra curtain of the present application realizes torsion presetting by installing leaf springs, thereby regulating the contraction torque of the scroll and completely receiving the curtain. Furthermore, by adopting the zebra curtain with this design, a side edge of the zebra curtain can be designed to be much narrower than that of a conventional zebra curtain, so that a shading effect is better.

In conclusion, the above embodiments are not restrictive embodiments of the utility model. Any modification or equivalent variation made by those skilled in the art based on the essential contents of the utility model shall be included in the technical scope of the utility model.

The invention claimed is:

1. A hand-held narrow-edge curtain, comprising a left bracket, a right bracket corresponding to the left bracket, and a component connected to the left bracket and the right bracket, wherein a scroll is arranged on the left bracket and the right bracket and a roller blind is arranged on the scroll, wherein coiling apparatuses used for coiling the scroll are respectively arranged on the left bracket and the right bracket; and each coiling apparatus comprises:

a regulating plunger nested with a toothed turntable;

a spring, a reed fixing disc and a reed coiling disc, wherein the spring is sleeved on the reed fixing disc in a relaxed state, and a coiling end of the spring is clamped with the reed coiling disc, wherein the reed coiling disc has a first gear; and a second gear engaged with the first gear, wherein a portion of the second gear is inserted into the regulating plunger, wherein the regulating plunger includes:

a plunger body in interference fit with the scroll, wherein a via hole is formed in a center of the plunger body; and a plunger shaft, wherein a front part of the plunger shaft is provided with a clamping part clamped with the via hole, an internal spline is arranged in a center of a tail of the plunger shaft, and a central section of the plunger shaft has a bump.

2. The hand-held narrow-edge curtain of claim 1, wherein the turntable is hollow, and has a notch assembled with the bump at a hollow part; a front part of the turntable also has a hollow column with a notch; the hollow column is used for the plunger shaft to penetrate; and a bottom of the turntable is provided with a slot part assembled with the tail of the plunger shaft.

3. The hand-held narrow-edge curtain of claim 2, wherein the second gear is provided with an external spline matched with the internal spline.

4. The hand-held narrow-edge curtain of claim 3, wherein the left bracket and the right bracket have the same structure, and have a shell and an end cover which are symmetrical; the end cover and the shell are mutually buckled and screwed; the shell is provided with a through hole used for the external spline to penetrate; and the shell is also provided with a groove for installing the reed fixing disc and the reed coiling disc.

5. The hand-held narrow-edge curtain of claim 4, wherein the groove has a first positioning pin and a second positioning pin used for inserting the reed fixing disc and the reed coiling disc.

6. The hand-held narrow-edge curtain of claim 5, wherein a bottom of the roller blind is provided with a bottom rod; a counterweight is arranged in the bottom rod;

and a middle of the bottom rod is provided with a handle part.

* * * * *